US010000364B2

(12) United States Patent
Shiokawa

(10) Patent No.: US 10,000,364 B2
(45) Date of Patent: Jun. 19, 2018

(54) VEHICLE WITH WINCH

(71) Applicant: HONDA MOTOR CO., LTD., Tokyo (JP)

(72) Inventor: Tatsuya Shiokawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 573 days.

(21) Appl. No.: 14/663,906

(22) Filed: Mar. 20, 2015

(65) Prior Publication Data

US 2015/0274493 A1 Oct. 1, 2015

(30) Foreign Application Priority Data

Mar. 28, 2014 (JP) ..... 2014-067834

(51) Int. Cl.
*B66D 1/12* (2006.01)
*B66D 1/28* (2006.01)
*B66D 1/00* (2006.01)

(52) U.S. Cl.
CPC ..... *B66D 1/12* (2013.01); *B66D 1/00* (2013.01); *B66D 1/28* (2013.01)

(58) Field of Classification Search
CPC ..... B66D 1/02; B66D 1/28
See application file for complete search history.

(56) References Cited

U.S. PATENT DOCUMENTS 8,701,809 B2 * 4/2014 Ikemoto ..... B60L 3/0046 180/65.265
2003/0021662 A1 * 1/2003 Ramsey ..... B62D 43/045 414/463
2004/0263100 A1 * 12/2004 Heravi ..... B60P 3/12 318/280
2008/0099738 A1 * 5/2008 Burns ..... B66D 1/12 254/323
2017/0062793 A1 * 3/2017 Zakharyan ..... H01M 2/34

FOREIGN PATENT DOCUMENTS

JP 2010-083272 4/2010

* cited by examiner

*Primary Examiner* — Emmanuel M Marcelo
(74) *Attorney, Agent, or Firm* — Rankin, Hill & Clark LLP

(57) ABSTRACT

In a vehicle having a vehicle body frame from which left and right front wheels are suspended, a winch is mounted so as to be disposed between the front wheels and configured to appropriately wire a plurality of conductors to a contactor interposed between the winch and a battery. Winch positive and negative side terminals, a battery positive side terminal and a grounding negative side terminal are disposed in a concentrated manner on a terminal disposition face of the contactor. Winch positive and negative side conductors extend from the contactor to the winch side. A battery positive side conductor and a grounding conductor extend from the contactor in directions different from the extending direction of the winch positive and negative side conductors from the contactor and different from each other.

3 Claims, 9 Drawing Sheets

VEHICLE WITH WINCH

BACKGROUND OF THE INVENTION

Field of the Invention

The present invention relates to a vehicle with a winch in which the winch is mounted on a vehicle body frame so as to be disposed between left and right front wheels.

Description of Related Art

A vehicle with a winch is known from Japanese Patent Laid-Open No. 2010-83272. In such a device, the winch is connected to a battery through a contactor which serves as a controller for the winch. To a face of the contactor on which terminals are disposed, conductors from the battery and conductors to the winch are connected in a concentrated manner. Since a plurality of terminals are disposed on the terminal disposition face of the contactor which is small in area, it is necessary to take care of wiring of the plurality of conductors to the contactor.

SUMMARY OF THE INVENTION

The present invention has been made in view of such a situation as described above, and it is an object of the present invention to provide a vehicle with a winch in which a plurality of conductors can be wired appropriately to a contactor interposed between the winch and a battery.

In order to achieve the object described above, according to the present invention, a vehicle with a winch in which, on a vehicle body frame on which left and right front wheels are suspended, a winch is mounted so as to be disposed between the front wheels. A battery connected to the winch through a contractor is disposed in the rear of the contactor which, in turn, is disposed in the rear of the winch. Winch positive and negative side terminals, a battery positive side terminal that is connected to a positive electrode of the battery, and a grounding negative side terminal that is grounded are disposed in a concentrated manner on a terminal disposition face that is one of a plurality of side faces that configure an outer face of the contactor and face in directions different from each other. Winch positive and negative side conductors connected to the winch positive and negative side terminals, respectively, extend from the contactor to the winch side. A battery positive side conductor connected to the battery positive side terminal and a grounding conductor connected to the grounding negative side terminal extend from the contactor in directions different from the extending direction of the winch positive and negative side conductors from the contactor and different from each other. A wall portion for defining the extending directions of the winch positive and negative side conductors, the battery positive side conductor and grounding conductor is provided on an inner face of a contactor cover, which is attached to the contactor so as to cover the terminal disposition face.

In further accordance with the present invention, the battery has the positive electrode on the right side thereof to the front of the vehicle and has a negative electrode on the left side thereof to the front of the vehicle. The battery positive side conductor connected to the positive electrode is wired so as to be directed to the right side of the contactor to the front of the vehicle. The grounding conductor is wired so as to be directed to the left side of the contactor to the front of the vehicle. The winch positive and negative side conductors extend forwardly from the contactor.

As a result of the present invention, the wiring schemes between the contactor disposed between the winch and the battery and the battery and winch can be optimized. Also, the wall portion for defining the extending directions of the winch positive and negative side conductors, the battery positive side conductor and grounding conductor is provided on the inner face of the contactor cover, which is attached to the contactor so as to cover the terminal disposition face. Therefore, short-circuiting between the terminals can be prevented with certainty.

As such, the extending directions of the battery positive side conductor and the grounding conductor from the contactor can be made different by 180 degrees to the opposite left and right sides, and the winch positive and negative side conductors are directed to directions different by 90 degrees from that of the battery positive side conductor and the grounding conductor. Consequently, the wiring scheme by which the conductors do not contact with each other can be achieved.

In further accordance with the present invention, a starter magnet is disposed on the right side of the battery to the front of the vehicle. The positive electrode of the battery and the starter magnet are connected to each other through a conductor. The battery positive side terminal of the contactor and the conductor are connected to each other through the battery positive side conductor.

Therefore, upon maintenance of the battery, only it is necessary to remove the conductor between the battery and the starter magnet from the positive electrode of the battery. Consequently, it can be prevented to forget attaching of the winch side wiring lines when the battery is assembled.

DETAILED DESCRIPTION OF THE INVENTION

An embodiment of the present invention is described with reference to FIGS. 1 to 9 of the accompanying drawings. It is to be noted that, in the following description, forward and backward, leftward and rightward, and upward and downward directions are defined as directions as viewed from an occupant on a four-wheeled vehicle.

Figure 1:
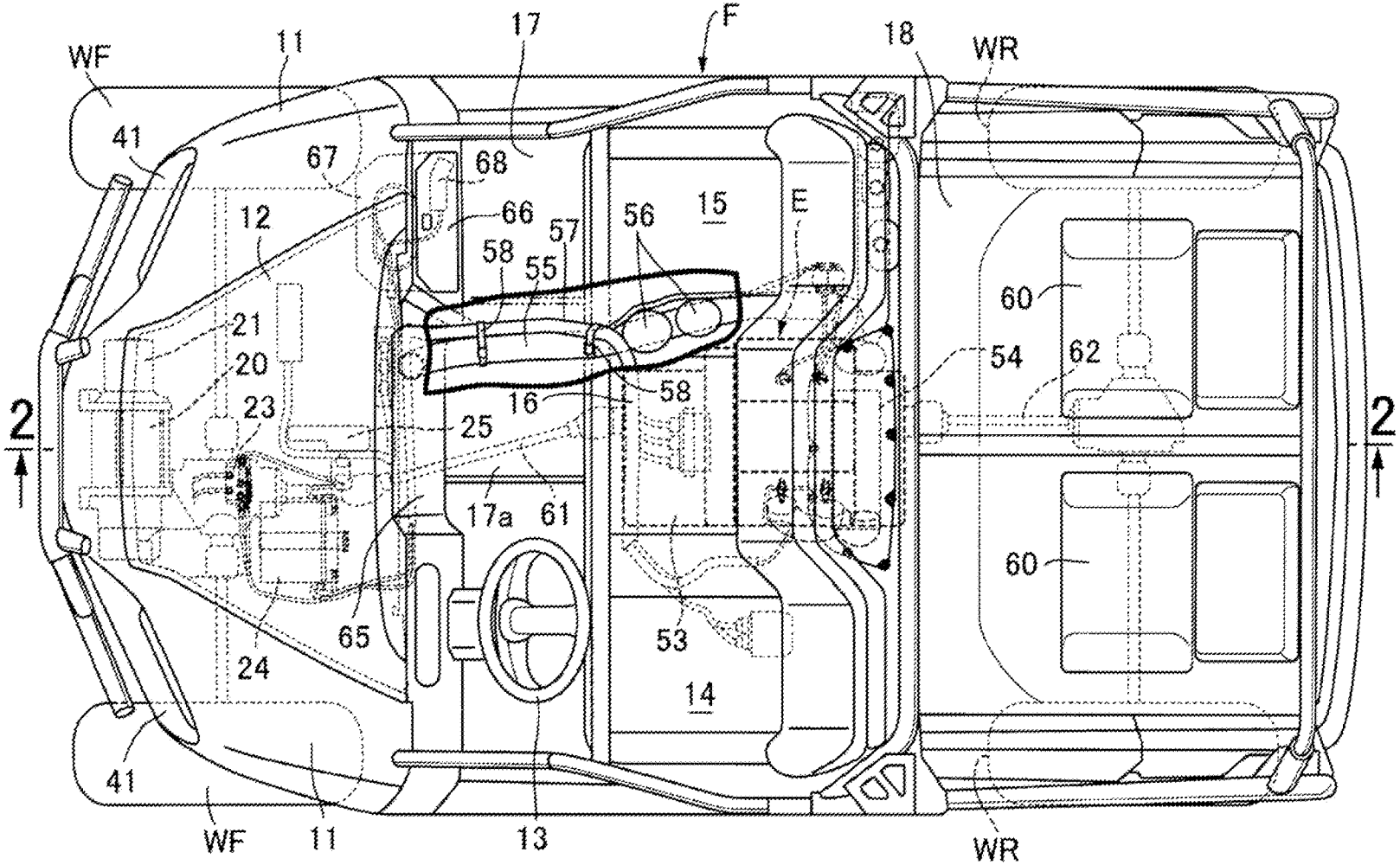
FIG. 1 is a top plan view of a four-wheeled vehicle.
Figure 2:
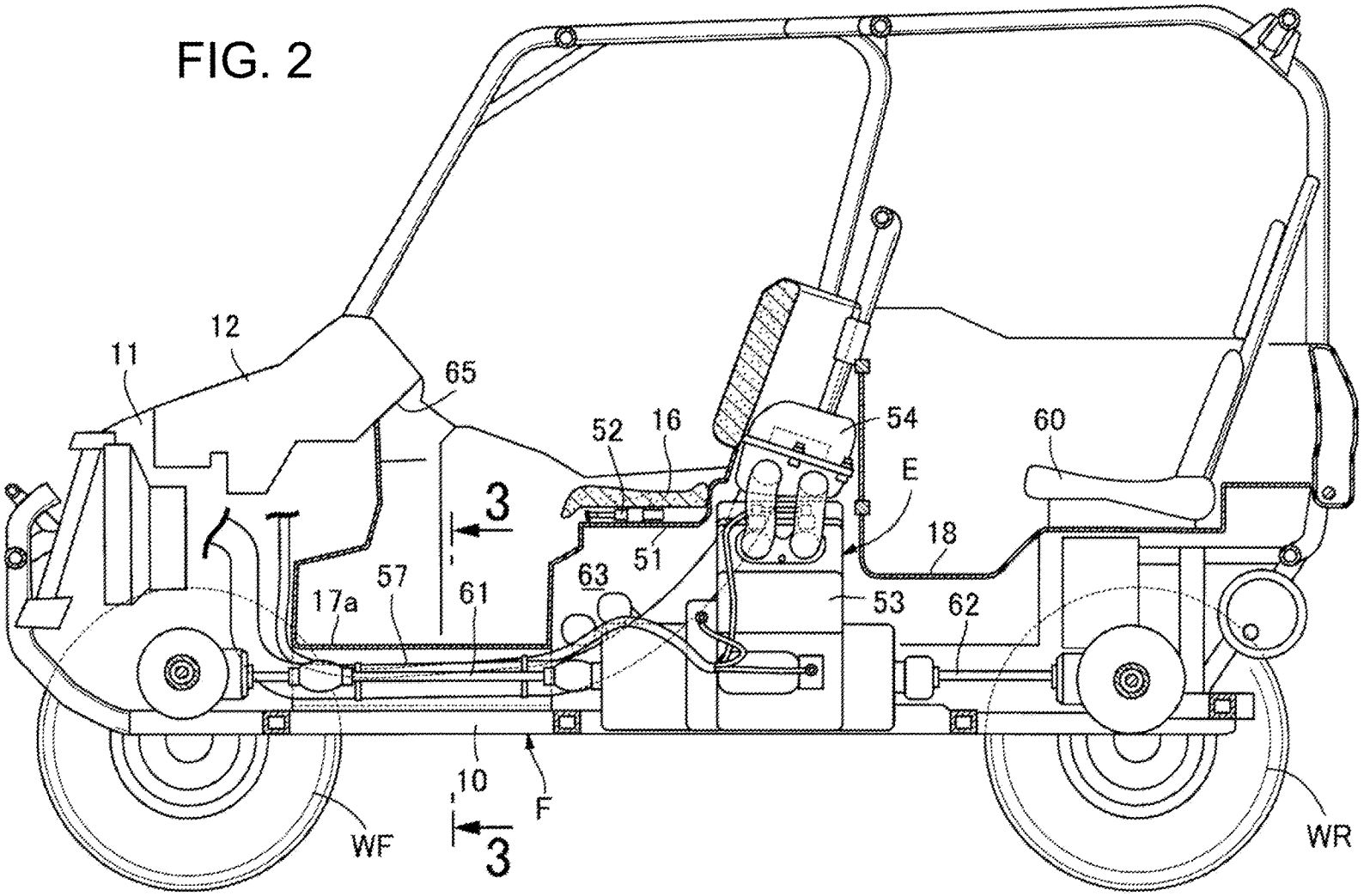
FIG. 2 is a sectional view taken along line 2-2 of FIG. 1.

Referring first to FIGS. 1 and 2, the four-wheeled vehicle is for off-road traveling and includes left and right front wheels WF suspended at a front portion of a vehicle body frame F. The vehicle body frame F has left and right side beams 10 extending in the forward and backward direction in a spaced relationship from each other in a vehicle widthwise direction. Left and right rear wheels WR are suspended at a rear portion of the vehicle body frame F.

Left and right fenders 11 are supported at a front portion of the vehicle body frame F in such a manner as to cover the front wheels WF from above. A bonnet 12 is supported for opening and closing movement on the fenders 11 so as to be disposed between the fenders 11. A driver seat 14 and a passenger seat 15 are disposed at an intermediate portion of the vehicle body frame F in the forward and backward direction. The driver seat 14 is disposed behind a steering wheel 13 which steers the left and right front wheels WR, and the passenger seat 15 is disposed on one side (in the present embodiment, on the right side) of the driver seat 14. The driver seat 14 and the passenger seat 15 are connected to each other through an intermediate seat 16 which functions as a second passenger seat. A front floor 17 is supported on the vehicle body frame F behind the front fenders 11 and the bonnet 12 such that a driver seated on the driver seat 14 and passengers seated on the passenger seat 15 and the intermediate seat 16 can place the feet thereon. A rear floor 18 is supported at a rear portion of the vehicle body frame F such that a passenger can get thereon. For example, left and right passenger seats 60 are provided on the rear floor 18.

An engine E is supported on the vehicle body frame F so as to be disposed below the intermediate seat 16. A front wheel drive shaft 61 for driving the left and right front wheels WF extends forwardly from an engine main body 53 of the engine E, and a rear wheel drive shaft 62 for driving the left and right rear wheels WR extends rearwardly from the engine main body 53.

Figure 3:
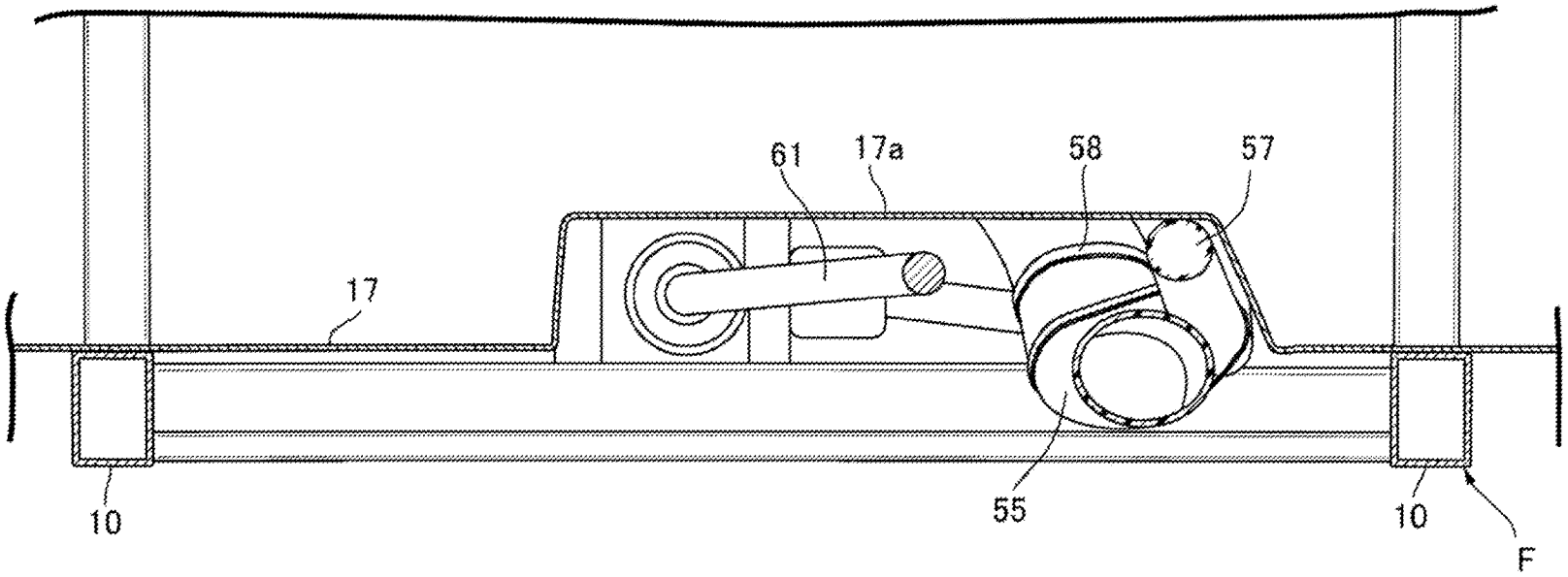
FIG. 3 is a sectional view taken along line 3-3 of FIG. 2.
Figure 4:
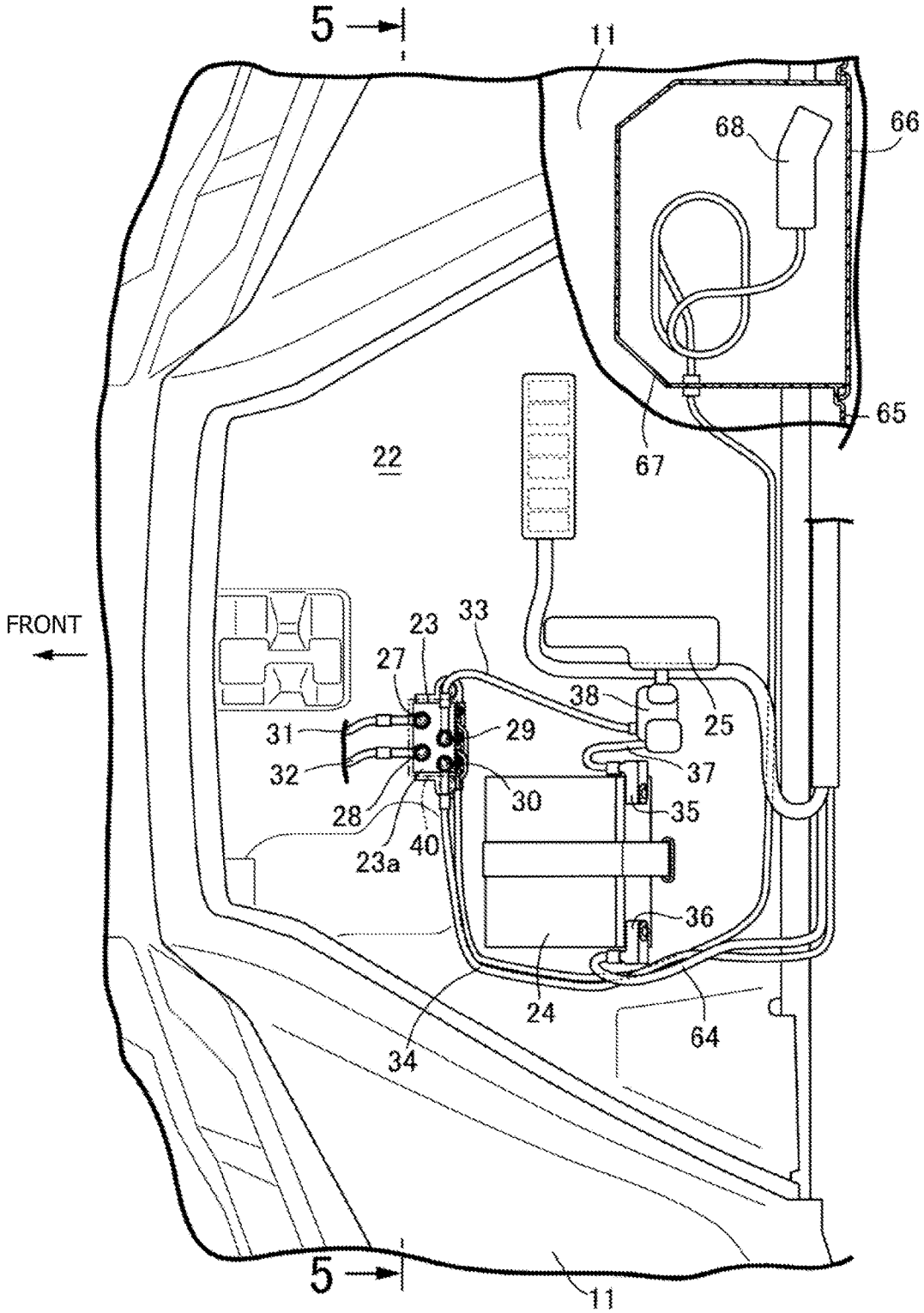
FIG. 4 is a top plan view of a front portion of the four-wheeled vehicle with a bonnet omitted.
Figure 5:
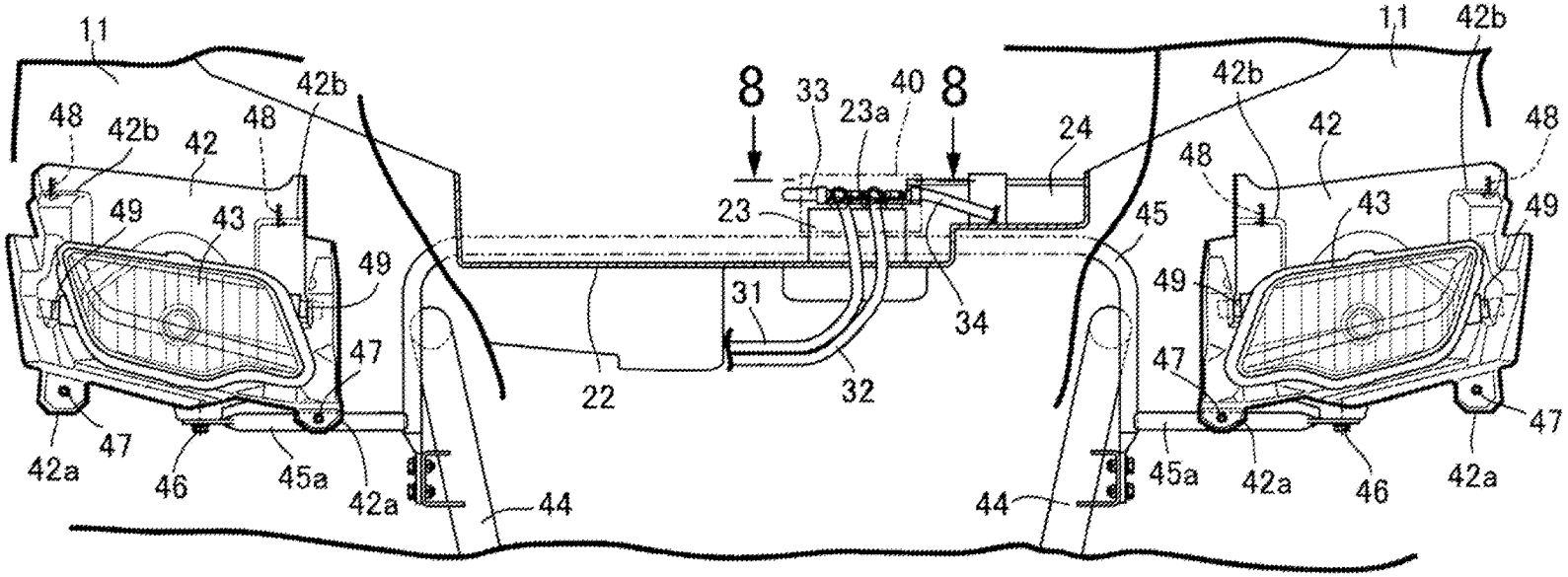
FIG. 5 is a sectional view taken along line 5-5 of FIG. 4.
Figure 6:
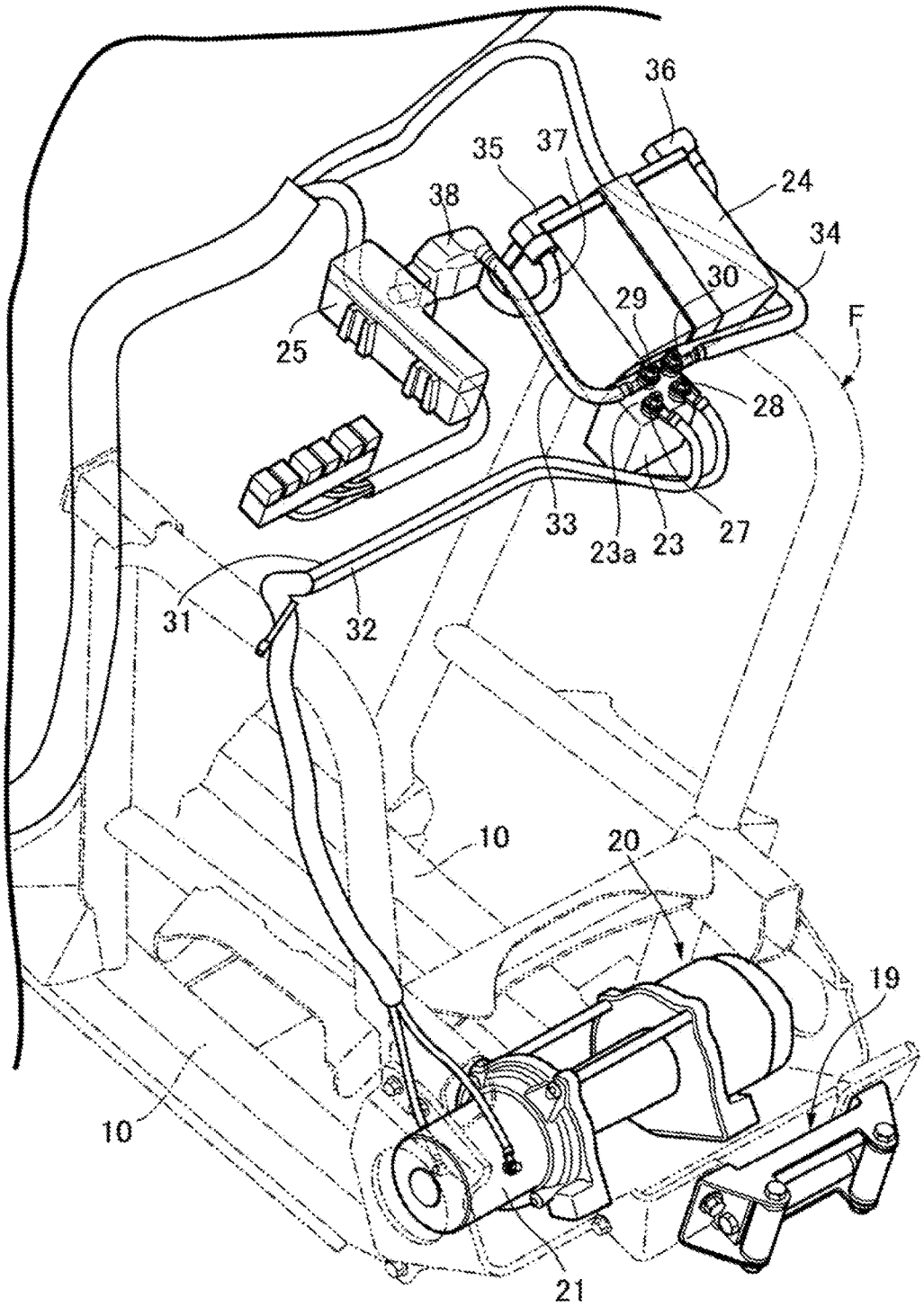
FIG. 6 is a perspective view depicting a relative arrangement of a winch, a contactor, a battery and a starter magnet.

Referring also to FIG. 3, a tunnel portion 17*a* is formed in an upwardly swollen state at a portion of the front floor 17, which corresponds to the intermediate seat 16 between the driver seat 14 and the passenger seat 15, between the left and right side beams 10. The tunnel portion 17*a* connects an engine room 63 and a portion of a front portion of the vehicle, which is covered with the bonnet 12. The engine room 63 is formed below the intermediate seat 16 such that the engine main body 53 is disposed therein. The front wheel drive shaft 61, an air intake duct 55 and a main harness 57 are accommodated in the tunnel portion 17*a*. The air intake duct 55 is for supplying air into the engine main body 53. The main harness 57 is a bundle of conductors connected to a plurality of electric parts provided on the engine E.

An air cleaner 54 of the engine E is disposed above the engine main body 53, and the air intake duct 55 has a plurality of resonators 56 provided therefor and extends forwardly from a right end portion of the air cleaner 54. Meanwhile, the main harness 57 is disposed along the air intake duct 55 and is supported at a plurality of locations thereof by harness holders 58 attached to the air intake duct 55.

A heat shield plate 51 is provided between the driver seat 14, passenger seat 15 and intermediate seat 16 and the engine E, and an ECU 52 is supported on the heat shield plate 51 below the intermediate seat 16.

Referring also to FIGS. 4 to 7, a winch 20 is mounted at a front portion of the vehicle body frame F in such a manner as to be disposed between the front wheels WF. A support plate 22 is supported at a front portion of the vehicle body frame F such that it can be covered from above with the bonnet 12 and in turn covers the winch 20 from above. A wire guide 19 is supported at a front end portion of the vehicle body frame F so as to be disposed in front of the winch 20.

A contactor 23, a battery 24 and a starter magnet 25 are supported on the support plate 22. The contactor 23 is disposed behind the winch 20. The battery 24 is disposed behind the contactor 23 and connected to an electric motor 21 of the winch 20 through the contactor 23. The starter magnet 25 is disposed in the proximity of the right side of the battery 24 to the front of the vehicle.

An outer face of the contactor 23 is formed such that it has a plurality of side faces facing in directions different from each other. One of the side faces which faces upwardly is configured as a terminal disposition face 23*a*. A winch positive side terminal 27 and a winch negative side terminal 28 as well as a battery positive side terminal 29 and a grounding negative side terminal 30 are disposed in a concentrated manner on the terminal disposition face 23*a*.

Winch positive and negative side conductors 31 and 32 are connected to the winch positive and negative side terminals 27 and 28, respectively, and extend from the contactor 23 to the winch 20 side and are connected to the electric motor 21 of the winch 20. Further, a battery positive side conductor 33 and a grounding conductor 34 are connected to the battery positive side terminal 29 and the grounding negative side terminal 30, respectively, and extend from the contactor 23 in directions different from each other and different from the extending direction of the winch positive and negative side conductors 31 and 32 from the contactor 23.

Incidentally, the battery 24 has a positive electrode 35 on the right side thereof to the front of the vehicle and has a negative electrode 36 on the left side thereof to the front of the vehicle. The battery positive side conductor 33 is connected to the positive electrode 35 and wired in the rightward direction from the contactor 23 to the front of the vehicle. The grounding conductor 34 is connected to the grounding negative side terminal 30 and wired in the leftward direction from the contactor 23 to the front of the vehicle. A grounding conductor 64 is connected to the negative electrode 36 and extends rearwardly together with the grounding conductor 34 such that it is connected, for example, to the engine main body 53. Further, the winch positive and negative side conductors 31 and 32 extend forwardly from the contactor 23.

A connector 38 that is connected to the starter magnet 25 disposed on the right side of the battery 24 to the front of the vehicle and the positive electrode 35 of the battery 24 are connected to each other by a conductor 37, and the battery positive side conductor 33 is connected to the conductor 37 through the connector 38. Consequently, also the starter magnet 25 and the battery positive side terminal 29 of the contactor 23 are connected to each other through the battery positive side conductor 33 and the conductor 37.

Figure 8:
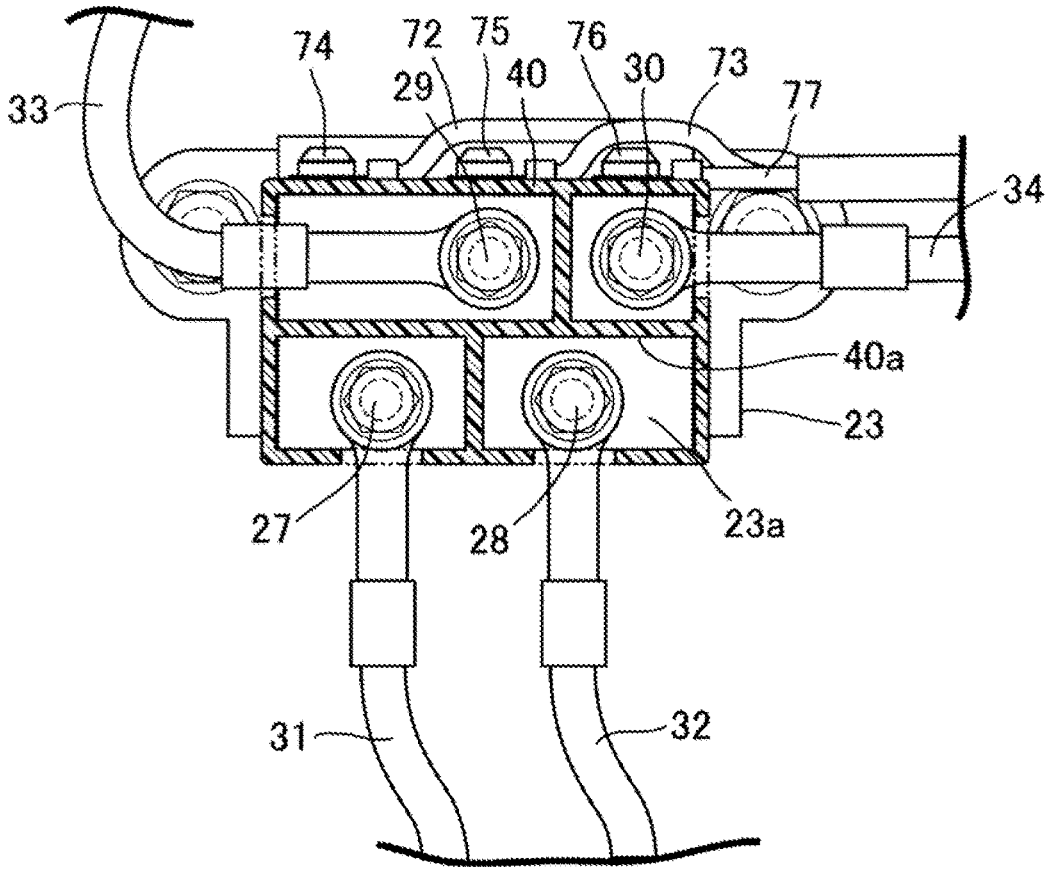
FIG. 8 is a sectional view taken along line 8-8 of FIG. 5.

Referring to FIG. 8, a contactor cover 40 is removably attached to the contactor 23 such that it covers the terminal disposition face 23*a* of the contactor 23. A wall portion 40*a* is provided on an inner face of the contactor cover 40. The wall portion 40*a* defines the extending direction of the winch positive and negative side conductors 31 and 32, the battery positive side conductor 33 and grounding conductor 34.

A dashboard 65 is provided between the left and right fenders 11 in front of the driver seat 14, passenger seat 15 and intermediate seat 16. A console box 67 is formed on the dashboard 65 in front of the passenger seat 15 and has a lid 66 attached thereto for opening and closing movement. A controller 68 is accommodated in the console box 67 and controls operation and the rotation direction of the electric motor 21 of the winch 20.

Figure 7:
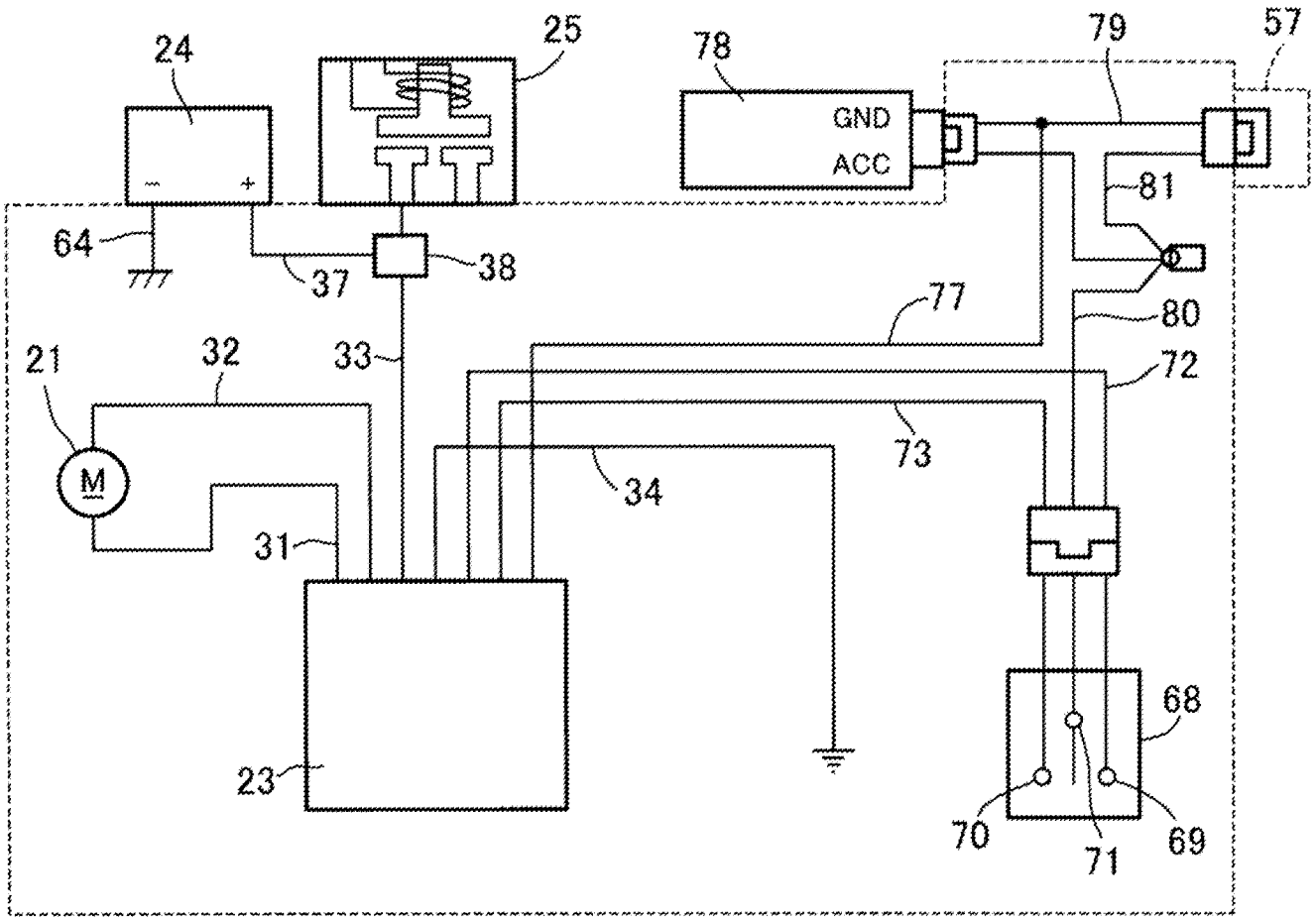
FIG. 7 is an electric circuit diagram relating to an electric motor of the winch.

Referring particularly to FIG. 7, the controller 68 is a switch having a pair of individual contacts 69 and 70 and a common contact 71. The controller 68 can switchably establish a state in which the common contact 71 conducts to one of the pair of individual contacts 69 and 70, another state in which the common contact 71 conducts to the other of the pair of the individual contacts 69 and 70 and a further state in which the common contact 71 does not conduct to any of the individual contacts 69 and 70. The individual contacts 69 and 70 are connected to the contactor 23 through conductors 72 and 73, respectively.

Incidentally, controller first and second terminals 74 and 75 and a grounding terminal 76 are provided on one of the plurality of side faces of the contactor 23 that faces the rear side as depicted in FIG. 8. The conductors 72 and 73 connect to the individual contacts 69 and 70 and are connected to the controller first and second terminals 74 and 75, respectively. Further, a conductor 77 connects to the grounding terminal 76 and is connected to a grounding conductor of the main harness 57 and a GND terminal of an ACC socket 78. Further, a conductor 79 connects to the common contact 71 of the controller 68 and is connected to a power supplying conductor 81 of the main harness 57 together with an ACC terminal of the socket 78.

Figure 9:
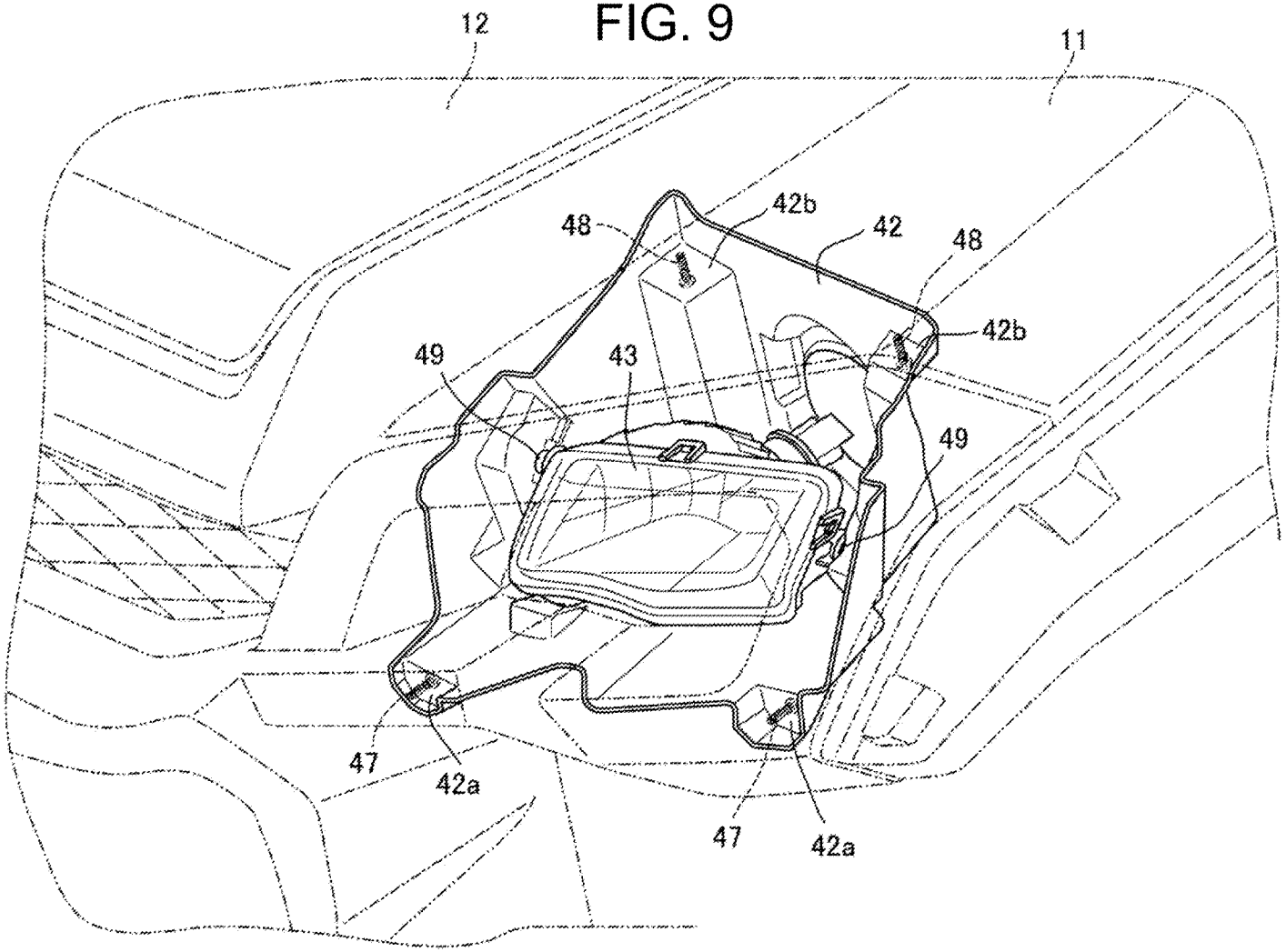
FIG. 9 is a perspective view of a headlamp.

Referring to FIG. 9, a headlamp opening 41 (refer to FIG. 1) is provided at a front end portion of each of the left and right fenders 11. A headlamp case 42 is formed in a box shape such that the front end opening thereof faces the opening 41, and is supported on the vehicle body frame F and each of the fenders 11. A headlamp 43 is supported on the headlamp case 42 such that the optical axis thereof can be adjusted.

The vehicle body frame F has, at a front end portion thereof, left and right frame members 44 extending in the upward and downward direction. A case supporting frame 45 is fastened to the frame members 44 and has supporting arm portions 45*a* that are disposed below the left and right headlamp cases 42 and extend leftwardly and rightwardly. The headlamp cases 42 are fastened at a lower portion thereof to an outer end portion of the supporting arm portions 45*a* by screw members 46.

Left and right front portion supporting plate portions 42*a* are provided integrally at a lower portion of the front side of the headlamp case 42 such that they face the front. Left and right rear portion supporting plate portions 42*b* are provided integrally at an upper portion of the rear side of the headlamp case 42 such that they face upwardly. The front portion supporting plate portions 42*a* are fastened to an inner face of a lower portion of the front side of the fender 11 by screw members 47 fitted therein from the rear side. The rear portion supporting plate portions 42*b* are fastened to an inner face of an upper portion of the fender 11 by screw members 48 fitted therein from below.

Support shafts 49 are provided coaxially on the headlamps 43 such that they extend leftwardly and rightwardly and are fitted in and supported by the headlamp case 42.

Now, operation of the embodiment is described. The battery 24 connected to the winch 20 through the contactor 23 is disposed in the rear of the contactor 23 which is disposed in the rear of the winch 20. The winch positive and negative side terminals 27 and 28 and the battery positive side terminal 29 and grounding negative side terminal 30 are disposed in a concentrated manner on the terminal disposition face 23*a*, which is one of a plurality of side faces that configure the outer face of the contactor 23 and face in directions different from each other. Further, the winch positive and negative side conductors 31 and 32 connected to the winch positive and negative side terminals 27 and 28, respectively, extend from the contactor 23 to the winch 20 side, and the battery positive side conductor 33 connected to the battery positive side terminal 29 and the grounding conductor 34 connected to the grounding negative side terminal 30 extend from the contactor 23 in directions different from the extending direction of the winch positive and negative side conductors 31 and 32 from the contactor 23 and different from each other. Therefore, the wiring schemes between the contactor 23 disposed between the winch 20 and the battery 24 and the battery 24 and winch 20 can be optimized.

Besides, the wall portion 40*a* that defines the extending directions of the winch positive and negative side conductors 31 and 32, the battery positive side conductor 33 and grounding conductor 34 is provided on the inner face of the contactor cover 40 attached to the contactor 23 so as to cover the terminal disposition face 23*a*. Therefore, short-circuiting between the winch positive side terminal 27, winch negative side terminal 28, battery positive side terminal 29 and grounding negative side terminal 30 can be prevented with certainty.

Further, the battery 24 has the positive electrode 35 on the right side to the front of the vehicle and has the negative electrode 36 on the left side to the front of the vehicle. Further, the battery positive side conductor 33 connected to the positive electrode 35 is wired so as to be directed to the right side of the contactor 23 to the front of the vehicle. The grounding conductor 34 connected to the grounding negative side terminal 30 is wired so as to be directed to the left side of the contactor 23 to the front of the vehicle. The winch positive and negative side conductors 31 and 32 extend forwardly from the contactor 23. Therefore, the extending directions of the battery positive side conductor 33 and the grounding conductor 34 from the contactor 23 can be made different by 180 degrees to the opposite left and right sides, and the winch positive and negative side conductors 31 and 32 are directed to directions different by 90 degrees from that of the battery positive side conductor 33 and the grounding conductor 34. Consequently, the wiring scheme by which the conductors 31 to 34 do not contact with each other can be achieved.

Furthermore, the starter magnet 25 is disposed on the right side of the battery 24 to the front of the vehicle, and the positive electrode 35 of the battery 24 and the starter magnet 25 are connected to each other through the conductor 37. Further, the battery positive side terminal 29 of the contactor 23 and the conductor 37 are connected to each other through the battery positive side conductor 33. Therefore, upon maintenance of the battery 24, it is only necessary to remove the conductor 37 between the battery 24 and the starter magnet 25 from the positive electrode 35 of the battery 24. Consequently, it can be prevented to forget attaching of the winch side wiring lines when the battery 24 is assembled.

While the embodiment of the present invention has been described, the present invention is not limited to the embodiment described above, but it is possible to carry out various design changes without departing from the present invention described in the claims.

DESCRIPTION OF REFERENCE SYMBOLS

20 . . . Winch
23 . . . Contactor
23*a* . . . Terminal disposition face
24 . . . Battery
25 . . . Starter magnet
27 . . . Winch positive side terminal
28 . . . Winch negative side terminal
29 . . . Battery positive side terminal
30 . . . Grounding negative side terminal
31 . . . Winch positive side conductor
32 . . . Winch negative side conductor
33 . . . Battery positive side conductor
34 . . . Grounding conductor

35 . . . Positive electrode
36 . . . Negative electrode
37 . . . Conductor
40 . . . Contactor cover
40*a* . . . Wall portion
F . . . Vehicle body frame
WF . . . Front wheel

What is claimed is:

1. A vehicle with a winch in which, on a vehicle body frame on which left and right front wheels are suspended, the winch is mounted so as to be disposed between the front wheels, wherein a battery connected to the winch through a contactor is disposed in a rear of the contactor that is disposed in a rear of the winch;

winch positive and negative side terminals, a battery positive side terminal that is connected to a positive electrode of the battery and a grounding negative side terminal that is grounded are disposed in a concentrated manner on a terminal disposition face that is one of a plurality of side faces that configure an outer face of the contactor and face in directions different from each other;

winch positive and negative side conductors that are connected to the winch positive and negative side terminals, respectively, extend from the contactor to a winch side;

a battery positive side conductor that is connected to the battery positive side terminal and a grounding conductor that is connected to the grounding negative side terminal extend from the contactor in directions different from an extending direction of the winch positive and negative side conductors from the contactor and different from each other; and a wall portion for defining the extending directions of the winch positive and negative side conductors, the battery positive side conductor and grounding conductor is provided on an inner face of a contactor cover that is attached to the contactor so as to cover the terminal disposition face.

2. The vehicle with a winch according to claim 1, wherein the battery has the positive electrode on a right side thereof to a front of the vehicle and has a negative electrode on a left side thereof to the front of the vehicle;

the battery positive side conductor connected to the positive electrode is wired so as to be directed to a right side of the contactor to the front of the vehicle;

the grounding conductor is wired so as to be directed to a left side of the contactor to the front of the vehicle; and the winch positive and negative side conductors extend forwardly from the contactor.

3. The vehicle with a winch according to claim 2, wherein a starter magnet is disposed on the right side of the battery to the front of the vehicle;

the positive electrode of the battery and the starter magnet are connected to each other through a conductor; and the battery positive side terminal of the contactor and the conductor are connected to each other through the battery positive side conductor.

* * * * *